US006755964B1

(12) United States Patent
Agrawal et al.

(10) Patent No.: US 6,755,964 B1
(45) Date of Patent: Jun. 29, 2004

(54) PROCESS FOR THE FIXED BED SWEETENING OF PETROLEUM DISTILLATES USING HALOGENATED METAL PHTHALOCYANINE AS A CATALYST

(75) Inventors: Brij Bahadur Agrawal, Dehradun (IN); Som Nath Puri, Dehradun (IN); Gautam Das, Dehradun (IN); Bir Sain, Dehradun (IN); Bhagwati Prasad Balodi, Dehradun (IN); Sunil Kumar, Dehradun (IN); Anil Kumar, Dehradun (IN); Pushpa Gupta, Dehradun (IN); Jai Prakash, Dehradun (IN); Onkar Singh Tyagi, Dehradun (IN); Turuga Sundara Rama Prasada Rao, Dehradun (IN); Gur Pratap Rai, Mumbai (IN)

(73) Assignee: Council of Scientific & Industrial Research, New Delhi (IN)

( * ) Notice: Subject to any disclaimer, the term of this patent is extended or adjusted under 35 U.S.C. 154(b) by 0 days.

(21) Appl. No.: 09/804,993

(22) Filed: Mar. 13, 2001

(30) Foreign Application Priority Data

Dec. 15, 2000 (IN) ..... 1159/DEL/00

(51) Int. Cl.[7] ..... C10G 19/00

(52) U.S. Cl. ..... 208/189; 208/203; 208/204; 208/206; 208/207

(58) Field of Search ..... 208/203, 204, 208/189, 206, 207

(56) References Cited

U.S. PATENT DOCUMENTS 4,088,569 A * 5/1978 Douglas ..... 208/206
4,411,776 A * 10/1983 Carlson ..... 208/206
5,683,574 A * 11/1997 Mazgarov et al. ..... 208/206

* cited by examiner

*Primary Examiner*—Walter D. Griffin
*Assistant Examiner*—James Arnold, Jr.
(74) *Attorney, Agent, or Firm*—Ladas & Parry

(57) ABSTRACT

A process for fixed bed sweetening of petroleum distillates using halogenating metal phthalocyanine as a catalyst comprising impregnating the catalyst on activated charcoal bed by circulating alcoholic alkaline solution of the catalyst through charcoal bed till colorless bed solution is obtained in the effluent, passing the petroleum distillate through the said catalyst loaded charcoal bed along with air or oxygen at a temperature and pressure with liquid hourly space velocity with continuous or intermittent injection of alkali solution such as sodium hydroxide of concentration to obtain the desired low mercaptan level petroleum distillates. The alkaline solution used is selected from methanolic and ethanolic solution of sodium hydroxide. The halogenated metal phthalocyanine catalyst used is selected from dichloro cobalt phthalocyanine and dibromo cobalt phthalocyanine. The petroleum fraction used is selected from diesel, kerosene and FCC gasoline.

21 Claims, No Drawings

PROCESS FOR THE FIXED BED SWEETENING OF PETROLEUM DISTILLATES USING HALOGENATED METAL PHTHALOCYANINE AS A CATALYST

The present invention relates to a process for the fixed bed sweetening of petroleum distillates using halogenated metal phthalocyanine as a catalyst.

Particularly the invention relates to the development of a process for fixed bed sweetening of petroleum fractions like FCC gasoline, jet fuel, kerosene, ATF, heavy naphtha thermal gasoline, diesel and distillate fuel oil using halogenated metal phthalocyanine as catalyst.

It is well known that the presence of mercaptans in the petroleum products like LPG, naphtha, gasoline, kerosene, ATF etc. is highly undesirable due to their foul odour and highly corrosive nature. These are also poison for the catalysts and adversely affect the response of TEL (tetraethyl lead) as octane booster. Although there are several processes known for the removal of mercaptans from these petroleum products, the most common practice is to oxidize the mercaptans present to less deleterious disulphides with air in the presence of a catalyst. Commonly lower mercaptans present in LPG, pentanes, LSRN are first extracted in alkali solution and then oxidized with air in the presence of a catalyst. The higher molecular weight mercaptans present in petroleum products like FCC gasoline, natural gas liquid (NGL), LSRN, thermal gasoline and distillate fuel oil are oxidized to disulphides with air in presence of alkali in a fixed bed reactor containing catalyst impregnated on a suitable support (Catal Rev. Sci. Eng. 35(4),571–609(1993).

In the hitherto known processes, phthalocyanines containing metals like cobalt, iron, manganese, molybdenum and vanadium are used to catalyze the oxidation of mercaptans to disulphides in alkaline medium. Among these cobalt and vanadium (especially cobalt) phthalocyanine and their derivatives are preferred. As these metal phthalocyanines are not soluble in aqueous medium, for improved catalyst activity their derivatives like sulphonated and carboxylated metal phthalocyanines are used as catalysts for sweetening of petroleum fractions. Various catalysts reported are cobalt phthalocyanine monosulphonate (U.S. Pat. Nos. 3,371,031; 4,009,120; 4,207,173; 4,028,269; 4,087,378; 4,141,819; 4,121,998; 4,124,494; 4,124,531), cobalt phthalocyanine disulphonate (U.S. Pat. No. 4, 250,022), tetrasulphonate (U.S. Pat. No. 2,622,763), mixture of mono- and disulphonate (U.S. Pat. No. 4,248,694), phenoxy-substituted cobalt phthalocynine (Ger. Offen 3,816,952), cobalt and vanadium chelates of 2,9,16,23-tetrakis (3,4-dicarboxybenzoyl) phthalocyanine for both homogeneous and fixed bed mercaptan oxidation (Ger. offen 2,757,476: Fr. Demande 2,375,201) and cobalt and vanadium chelates of tetrapyridinoporphyrazine (Ger. offen 2,441,648).

It is also hitherto known that because of poor solubility of cobalt phthalocyanine in aqueous or other medium it is difficult to impregnate the same on the bed of catalyst support material. The highly sulphonated or other similar derivatives of cobalt phthalocyanine, though are soluble in the impregnating solution, their high solubility makes it difficult to place the required amount of catalyst on the support material. Furthermore, the more highly sulphonated or other similar substituted metal phthalocyanines are susceptible to leaching from the catalyst support when it is made alkaline with sodium or potassium hyroxide solution. The leaching causes loss of catalyst from the bed.

Metal phthalocyanine monosulphonate are thus the preferred compounds for impregnation on the support material in the fixed bed sweetening. The most common method used for their preparation is the reaction of metal phthalocyanine with oleum or sulphuric acid. However this reaction is difficult to control so as to produce metal phthalocyanine monosulfonate, exclusively because in this reaction, along with monosulphonate di- and tri- sulphonated derivatives are also formed. These derivatives of metal phthalocyanines, especially of cobalt phthalocyanine are much more soluble in hydrocarbon and in caustic solution than the former. This solubility characteristic is very important when the catalyst is used for the fixed bed sweetening of petroleum fractions. The catalyst once placed on the carrier must remain attached so that catalytic activity is maintained. The catalyst therefore should be such that it could be easily impregnated on the fixed bed material and yet is not leached out by alkali solution or hydrocarbons during the sweetening process.

The main objective of the present invention is to provide a fixed bed process for the sweetening of petroleum fractions like kerosene, ATF, FCC gasoline, heavy naphtha, thermal gasoline; diesel and distillate fuel oil using halogenated metal phthalocyanine, as catalyst impregnated on a suitable support.

In another objective of the present invention the halogenated metal phthalocyanine could be dichloro or dibromo; diodo-, monochloro., mono-bromo; monoiodo- or similar derivatives of metal phthalocyanimies, preferably dichloro- or dibromo- derivatives of cobalt and iron phthalocyanine. These halogenated metal phthalocyanines can be prepared by treating the metal phthalocyanine with any conventional halogenating agent like chlorine, bromine, iodine, thionyl chloride, sulphuryl chloride, phosphorus pentachloride, phosphorus oxychloride, phosphorus pentabromide, phosphorus trichloride or similar halogenating agent, without any solvent or in solvents like dichloro benzene, nitrobenzene.

In another objective of the present invention provides a method for the impregnation of these novel sweetening catalysts on a suitable support material with catalyst dispersion on the support by circulating alcoholic alkaline solution of the catalyst through the bed till colourless solution is obtained in the effluent. The support material can also be impregnated by dipping, soaking, suspending or otherwise immersing the support in the form of spheres, pills, pellets, granules or other particles of uniform or irregular shape in alcoholic alkaline solution of the catalyst. The loading of the catalyst on the support material may vary from 0.01–5% preferably 0.1–1%. For making alcoholic alkaline solution, alcohol like methanol, ethanol etc. and alkalis like sodium hydroxide, potassium hydroxide or any other alkali may be used. The suitable support material includes naturally occurring clays and silicates for example diatomaceous earth, fuller's earth, Kieselguhr, feldspar, montmorillonite, hallogsite, Kaoline and the like; various charcoals produced by destructive distillation of wood, peat, lignite, nutshells, bones and other carbonaceous matter; naturally occurring or synthetically prepared inorganic oxides such as alumina, silica, zirconia, thoria, boria etc. or combinations thereof like silica-alumina, sillca-zirconia, alumina-zirconia etc. The preferred support material being charcoals with highly porous particle structure of increased adsorbent capacity generally defined as activated charcoal.

Accordingly the present invention provides a process for the fixed bed sweetening of petroleum distillates using halogenated metal phthalocyanine as a catalyst which comprise; impregnating the catalyst on activated charcoal bed by circulating alcoholic alkaline solution of the catalyst through charcoal bed till colourless solution is obtained in the effluent, passing the petroleum distillate through above said catalyst loaded charcoal bed along with air or oxygen at a temperature in the range of 20° C. to 100° C. and at a pressure in the range of 1kg/cm$^2$ to 15 kg/cm$^2$ with a liquid hourly space velocity in the range of 1 hr$^{-1}$ to 15 hr$^{-1}$ with continuous or intermittent injection of alkali solution such as sodium hydroxide of concentration in the range of 0.5–20%, to obtain the desired low mercaptan level petroleum distillates.

In an embodiment of the present invention the alcoholic alkaline solution used is selected from methanolic and ethanolic solution of sodium hydroxide.

In yet another embodiment of the present invention halogenated metal phthalocyanine catalyst used is selected from dichloro cobalt phthalocyanine and dibromo cobalt phthalocyanine.

In yet another embodiment of the present invention the concentration of the catalyst used in the fixed bed is in the range of 0.1 wt % to 1 wt % of activated charcoal.

In yet another embodiment of the present invention the halogenated metal phthalocyanine used is prepared as described and claimed in co-pending U.S. application Ser. No. 09/804,985, filed Mar. 13, 2001.

In yet another embodiment of the present invention the petroleum fraction used is selected from diesel, kerosene and FCC gasoline.

In yet another embodiment of the present invention the temperature is preferably in the range of 20° C. to 50° C.

In yet another embodiment of the present invention the pressure is preferably in the range of 5 kg/cm$^2$–8 kg/cm$^2$.

In yet another embodiment of the present invention the liquid hourly space velocity (LHSV) is preferably in the range of 1 hr$^{-1}$ to 6 hr$^{-1}$ .

In the sweetening process herein contemplated the undesirable mercaptans contained in a sour petroleum distillate are oxidised to form less deleterious disulphides in the presence of an alkaline reagent with air or oxygen gas. The impregnated support material used is initially saturated with the alkaline reagent, and the alkaline reagent thereafter admixed intermittently or continuously with the sour petroleum distillate passed through the bed. A desired alkalinity of the bed is always maintained during the process. Any suitable alkaline reagent may be employed but aqueous solution of sodium or potassium hydroxide is preferred.

The sweetening process with this catalytic system can be effected at ambient to 100° C. temperature, but the preferred temperature range is ambient to 50° C. The process may be effected at a pressure from atmospheric to as high as 30 kg/cm$^2$ or more with the preferable pressure range 5–8 kg/cm$^2$. The contact time equivalent to liquid hourly space velocity (LHSV) in the range 1–15, were found to be effective for the oxidation of mercaptans to disulphides. The optimum range for the LHSV was found to be 1–5 for achieving highest conversion. The petroleum distillate and air/oxygen can be passed upwardly or downwardly along with intermittent or continuous alkali injection through the bed. Also, the air may be passed counter current to the petroleum distillate.

The impregnated catalyst bed prepared according to the method of this invention was found to be active and stable. This bed can be used for treating large volume of sour petroleum distillates. As these halogenated metal phthalocyanines are not soluble in aqueous alkaline solution or hydrocarbon, hence they are not leached out from the bed of support material. After prolonged use, the bed gets deactivated and then attempts are made to revive the catalyst activity by regeneration of bed. When even after regeneration activity is not restored, then additional catalyst is reimpregnated by following standard procedure.

The halogenated metal phthalocyanine catalyst impregnated on the support is particularly suitable for the sweetening of wide range of sour petroleum distillates boiling above 140° C. like kerosene, jet fuel, fuel oil, naphtha, FCC gasoline and the like in a fixed bed treating system. These higher boiling distillates generally contain mercaptans, which are difficult to oxidize like tertiary mercaptans and aromaticthiols. The catalyst therefore has been evaluated with the feeds doped with various types of mercaptans in different concentrations as given in the examples. Although the supported catalyst of this invention is particularly applicable to the heavier petroleum distillates, it can also be used for the treatment of lower boiling distillates such as natural straight run and the cracked gasolines.

The following examples are given by way of illustration and therefore should not be construed to limit the scope of the invention.

PREPARATION OF THE CATALYST

EXAMPLE 1

30 parts by weight of cobalt phthalocyanine was slowly added with stirring to 400 parts by weight of thionyl chloride. The mixture was then refluxed (79° C.) with stirring for 4–5 hrs. The excess of thionyl chloride was then recovered by distillation from the reaction mixture and the residual mass added to 500 parts of ice cold water. The precipitated mass was filtered and washed with distilled/DM water till the washings were neutral. The mass was dried at 110° C. in air oven or at 50–80° C. under vacuum, yielding 32 parts of dichloro cobalt phthalocyanine.

EXAMPLE 2

In another typical preparation of the chlorinated cobalt phthalocyanine catalyst, 30 part by weight of cobalt phthalocyanine was added to about 400 parts of nitrobenzene, followed by addition of 150 parts of thionyl chloride. The mixture was heated with stirring at 60–80° C. for about 2 hrs. The reaction mass was then filtered, washed with ethanol and then ether and dried under vacuum at 80–100° C. This yields 32.5 parts of dichloro cobalt phthalocyanine.

IMPREGNATION OF THE CATALYSTS ON SUITABLE SUPPORT

Halogenated metal phthalocyanine catalysts prepared following the procedure described in this invention were found to be insoluble in aqueous alkaline solution, unlike commercial fixed bed sweetening catalysts. Therefore, as a part of this invention a process was developed for impregnating these catalysts on a suitable support. Following this procedure dichloro cobalt phthalocyanine catalyst of desired concentration can be impregnated on charcoal or any other suitable support material. This procedure can also be used for impregnating other halogenated metal phthalocyanines. The charcoal used for impregnation of dichloro cobalt phthalocyanine catalyst has following characteristics:

Bulk density, gm/cc 0.24–0.30

Pore volume, ml/g 0.7–0.8

Surface area m$^2$/g 700–800

Mesh size 10–30

The detailed description of the bench scale fixed bed unit used in the impregnation procedure has been given in "fixed bed process for sweetening of petroleum fraction" section of this invention. The impregnation of these catalysts can also be done following other procedures like dipping soaking, suspending, immersing etc. of the support material in alcoholic alkaline solution of the catalysts.

Charcoal (200 gm) is loaded into the reactor and methanol LR grade (1.0–1.2 litres) is pumped into the reactor with metering pump (flow rate 8–9 litres/hr), keeping the reactor outlet valve closed. The charcoal bed is kept submerged in methanol for 15 min to wet the charcoal. Reactor outlet valve is then opened and the methanol present in the system is circulated through the charcoal bed with the help of metering pump for 1 hr at a rate 6 to 9 litres/hr. Methanol is then drained out of the reactor. The remaining methanol from the bed and the system is flushed out with nitrogen gas and the total volume of methanol drained is measured. This methanol is used during subsequent impregnation of the catalyst on charcoal bed. Methanolic solution of sodium hydroxide (concentration 7%) is prepared by dissolving 17.5 gm of sodium hydroxide pellets in 50 ml of distilled water and diluting it to 250 ml with LR grade methanol followed by thorough shaking. One gram of dichloro cobalt phthalocyanine catalyst is used to obtain a bed with 0.5% catalyst loading on charcoal. The catalyst (1 gm) is taken in a 500 ml beaker and 7% methanolic sodium hydroxide solution (5–7 ml) is added to it. The mass is thoroughly mixed to obtain a thin paste. Additional 5–7 ml of the methanolic sodium hydroxide is then added and the mass is thoroughly stirred to solubilize most of the catalyst into methanolic sodium hydroxide. To this mixture now 20 ml of the methanolic sodium hydroxide is added and the mixture is thoroughly stirred to bring the catalyst in solution. The solution, thus obtained, is diluted with additional 150 ml of methanolic sodium hydroxide and stirred. This yields a solution of the catalyst with some particles still remaining undissolved. The mass is then allowed to stand at room temperature for about five minutes and the solution is then decanted to another 500 ml beaker. The undissolved catalyst particles remaining in the beaker are then solubilized in the remaining methanolic sodium hydroxide solution by stirring. The contents of the two beakers are then mixed and stirred thoroughly to obtain the solution of the catalyst in 7% methanolic sodium hydroxide.

The catalyst solution, 250 ml thus obtained, is then pumped into the reactor with metering pump (flow rate 8–9 litre/hr), keeping the outlet valve closed. Later another 500 ml methanol is added to this stream for dilution. The charcoal bed is kept submerged with catalyst solution for 15–20 minutes. Reactor outlet valve is then opened and the solution is circulated through the charcoal bed at the same flow rate. The circulation is continued till the eluted methanolic sodium, hydroxide solution is colourless, indicating the complete adsorption of the catalyst on the charcoal bed. The colourless methanolic solution of the sodium hydroxide is then drained out of the reactor and the system is flushed with nitrogen. The bed is then made alkaline in nitrogen atmosphere by charging, one litre of 10% aqueous sodium hydroxide solution into the reactor with metering pump (flow rate 6–9 litres/hr), keeping the reactor outlet valve closed. The bed is kept submerged in 10% aqueous sodium hydroxide solution for 2 hours. After this the alkali is drained out of the reactor and the bed is flushed with nitrogen. Now the bed is ready for evaluation, test.

FIXED BED SWEETENING OF PETROLEUM FRACTIONS

One of the embodiment of the present invention provides a fixed bed process for sweetening of sour petroleum fractions by impregnating these halogenated metal phthalocyanine catalyst on a suitable support. For this purpose a pilot unit is designed, fabricated and installed in the laboratory for the generation of the data and evaluation of different catalysts developed in the laboratory. In this unit the operating conditions very similar to those in the commercial fixed bed sweetening units can be maintained. During the present course of this invention, sweetening of various types of feeds doped with mercaptans, in presence of various halogenated metal phthalocyanine catalysts have been extensively studied in this unit under different conditions. Some examples using charcoal as bed material and dichloro cobalt phthalocyanine as catalyst under a set of conditions are given here.

Description of Fixed Bed Pilot Unit:

The schematic flow diagram of this unit is given in FIG. 1. This unit consists of two reactors—Reactor I(8) (Dia 70 mm: L=260 mm) and Reactor-II(9) (Dia 70 mm; L=360 mm) with provision to bypass either of the two. This complete set up is suitable for performance evaluation of the catalysts for fixed bed sweetening of sour petroleum fractions.

This unit can be operated at ambient to 100° C. temperature and under pressure of 1 to 12 kg/cm$^2$. Pump I(11) is used to supply feed from feed tank (1) to either of the reactors. Burette (6) is connected to measure feed rate. Air required for oxidation of mercaptan sulphur is supplied from the compressed air cylinder(3). Surge drum (4) is provided for separation of free moisture from the air. Pressure gauge (5) at the top of surge drum indicates the reactor inlet pressure. Flash drum (10) separates air and liquid product from the reactor effluent. Outlet air flow rate is measured by gas meter (14). To minimise corrosion to the gas meter, a trap (13) is provided in the system. Metering Pump II(12) is used for circulating the sodium hydroxide solution and demineralized (DM) water.

Feed Preparation and Results of Fixed Bed Sweetening:

The kerosene is doped with 1-octanethiol, 1-decanthiol and 1-dodecanthiol in different ratios to give a desired feed. The initial mercaptan sulphur content of the feed is estimated by UOP method 163–89. The feed and air are passed through the reactor bed of charcoal impregnated with dichloro cobalt phthalocyanine catalyst under following operating conditions:

Pressure, kg/cm$^2$ g 6–8

Reactor temperature, ° C. 40–45

Feed flow rate, litres/hr 1–6

Air flow rate, litres/min 0.8–5

The reactor effluent is passed through the separator drum to separate air and treated kerosene. The mercaptan sulphur content of the treated kerosene is estimated by UOP method 163–89.

Aqueous sodium hydroxide solution is injected to the charcoal bed intermittently to keep the mercaptan sulphur content in the treated kerosene below 10 ppm.

EXAMPLE 1

Feed was prepared by adding normal mercaptans ($C_7$-30%, $C_8$-60% and $C_{10}$-10%) to the kerosene to bring mercaptan sulphur content to 1056 ppmw. Dichloro cobalt phthalocyanine catalyst (0.4 gm) was impregnated on charcoal (200 gm) as per the procedure described earlier. The feed was passed through the catalyst impregnated bed under the conditions given in Table-1 and the mercaptan sulphur content of the feed coming out of the reactor was estimated.

TABLE 1

| | |
|---|---|
| Catalyst concentration, wt. % on charcoal bed | 0.2 |
| Mercaptan in feed, 'S' ppmw | 1056 |
| Pressure, kg/cm$^2$ g | 6.0 |
| Feed rate, liters/hr | 6.0 |
| Air flow rate, liters/min | 4–5 |
| Reactor temperature, ° C. | 31.5 |

| Cumulative feed processed, liters | Mercaptan concentration in product, 'S' ppmw | | | |
|---|---|---|---|---|
| | Run 1 | Run 2 | Run 3 | Run 4 |
| 1.00 | <1 | <1 | <1 | 3.20 |
| 2.00 | <1 | <1 | 1.19 | 2.38 |
| 3.00 | <1 | <1 | 1.00 | 2.26 |
| 4.00 | <1 | <1 | 1.00 | 3.77 |
| 5.00 | <1 | <1 | 1.50 | 3.92 |
| 6.00 | <1 | <1 | 2.83 | 3.00 |
| 7.00 | <1 | <1 | 3.00 | 3.14 |
| 8.00 | <1 | <1 | 3.20 | 4.00 |
| 9.00 | <1 | <1 | 1.20 | 3.05 |
| 10.00 | <1.3 | <1 | 4.70 | 5.48 |

EXAMPLE 2

Feed was prepared by adding normal and tertiary mercaptans ($nC_8$-50%, $nC_{10}$-27%, $nC_{12}$-20%, t-$C_{12}$-3%) to the kerosene to bring mercaptan sulphur content to 325 ppmw. The dichloro cobalt phthalocyanine catalyst (0.2 gm) was impregnated on charcoal (200 gm) as per the procedure described earlier. The feed was passed through the catalyst impregnated bed under the conditions given in Table 2 and the mercaptan sulphur content in the product coming out of the reactor was estimated.

TABLE 2

| | |
|---|---|
| Catalyst concentration, wt. % on charcoal bed | 0.1 |
| Mercaptan in feed, 'S' ppmw | 325 |
| Pressure, kg/cm$^2$ g | 6.00 |
| Air flow rate, liters/min | 1.2 |
| LHSV | 3.12 |
| Reaction temperature, ° C. | 40–45 |

| Cumulative feed processed, liters | Mercaptan in product, 'S' ppmw | Conversion of mercaptans to disulphides, % | Alkali injection |
|---|---|---|---|
| 5.0 | 1.56 | 99.54 | |
| 10.0 | 1.45 | 99.55 | |
| 15.0 | 5.24 | 98.38 | |
| 20.0 | 6.29 | 98.05 | |
| 25.0 | 10.07 | 96.88 | |
| 26.0 | 5.80 | 98.20 | 250 ml of 8% sodium hydroxide |
| 30.0 | 4.84 | 98.50 | |
| 35.0 | 9.55 | 97.04 | |
| 40.0 | 9.17 | 97.16 | |
| 43.0 | 12.53 | 96.12 | |
| 44.0 | 4.74 | 98.53 | 186 ml of 8% sodium hydroxide |
| 45.0 | 3.41 | 98.94 | |
| 50.0 | 7.80 | 97.67 | |
| 55.0 | 5.76 | 98.28 | |

EXAMPLE 3

Feed was prepared by adding normal mercaptans ($C_6$-40%, $C_7$-20%, $C_8$-40%) to the alkali treated FCC gasoline to bring mercaptan sulphur content to 194 ppmw. The dichloro cobalt phthalocyanine catalyst (0.2 gm) was impregnated on charcoal (200 gm) as per the procedure described earlier. The feed was passed through the catalyst impregnated bed in the conditions given in Table 3 and the mercaptan sulphur content in reactor effluent was estimated. Aqueous sodium hydroxide solution (0.05%) was continuously injected along with the feed at the rate of 1–2 ml/min.

TABLE 3

| | |
|---|---|
| Catalyst concentration, wt. % on charcoal bed | 0.1 |
| Mercaptan in feed, 'S' ppmw | 194 |
| Pressure, kg/cm$^2$ g | 6.0 |
| Air Flow rate, liters/hr | 1.2–1.4 |
| Feed flow rate, liters/min | 1.2–1.4 |
| Reaction temperature, ° C. | 40–45 |

| Cumulative feed processed, liters | Mercaptan in product, 'S' ppmw | Conversion of mercaptan to disulphides, % |
|---|---|---|
| 0.5 | 0.87 | 99.55 |
| 1.0 | 0.86 | 99.56 |
| 2.0 | 0.46 | 99.75 |
| 4.0 | 0.59 | 99.70 |
| 6.0 | 0.85 | 99.56 |
| 6.5 | 0.86 | 99.56 |
| 7.5 | 0.86 | 99.56 |
| 9.0 | 0.86 | 99.56 |
| 9.5 | 0.97 | 99.55 |
| 10.0 | 0.86 | 99.56 |

EXAMPLE 4

Feed was prepared by adding normal mercaptans ($C_6$-40%, $C_7$-20%, $C_8$-40%) and 60 ppm of thiophenol to the alkali treated FCC gasoline, the mercaptan sulphur content was found to be 222 ppmw. The dichloro cobalt phthalocyanine catalyst (0.2 gm) was impregnated on charcoal (200 gm) as per the procedure described earlier. The feed was passed through the catalyst impregnated bed under the conditions given in Table 4 and the mercaptan content in the product coming out of the reactor was estimated. Aqueous sodium hydroxide solution (0.05%) was continuously injected along with the feed at the rate of 1–2 ml/min.

TABLE 4

| | |
|---|---|
| Catalyst concentration, wt. % on charcoal bed | 0.1 |
| Mercaptan in feed, 'S' ppmw | 222 |
| Pressure, kg/cm$^2$ g | 6.0 |
| Air flow rate, liters/min | 0.8–1.0 |
| Feed flow rate, liters/hr | 1–1.4 |
| Reaction Temperature, ° C. | 40–45 |

| Cumulative feed processed, liters | Mercaptan in product, 'S' ppmw | Conversion of mercaptan to disulphides, % |
|---|---|---|
| 0.5 | 0.92 | 99.59 |
| 1.0 | 0.93 | 99.58 |
| 1.5 | 1.03 | 99.54 |
| 2.5 | 0.83 | 99.63 |
| 3.0 | 0.84 | 99.62 |
| 3.5 | 0.85 | 99.69 |
| 4.0 | 0.86 | 99.69 |
| 4.5 | 0.86 | 99.69 |
| 5.0 | 0.85 | 99.69 |
| 5.5 | 0.85 | 99.69 |
| 6.0 | 0.85 | 99.69 |

EXAMPLE 5

The feed was prepared by adding normal mercaptans ($C_8$-50%, $C_{10}$-30% and $C_{12}$-20%) to the kerosene to bring mercaptan sulphur content to 301 ppmw. Dibromo cobalt phthalocyanine catalyst (1.0 gm) was impregnated on charcoal (200 gm) as per the procedure described. The feed was passed through the catalyst impregnated bed in the conditions given in Table 5, and the mercaptan sulphur content of the reactor effluent was estimated.

TABLE 5

| | |
|---|---|
| Catalyst concentration, wt. % on charcoal bed | 0.5% |
| Mercaptan in feed, 'S' ppmw | 301 |
| Pressure, kg/cm$^2$ g | 6.0 |
| Air flow rate, liters/min | 1–1.2 |
| Feed flow rate, liter/hr | 1.3 |
| Reaction temperature, ° C. | 45–48 |

| Cumulative feed processed, liters | Mercaptan in product 'S' ppmw | Conversion of mercaptan to desulphides, % |
|---|---|---|
| 0.5 | 0.83 | 99.72 |
| 1.0 | <1 | >99.5 |
| 1.5 | <1 | >99.5 |
| 2.0 | <1 | >99.5 |
| 2.5 | <1 | >99.5 |
| 3.0 | <1 | >99.5 |
| 3.5 | <1 | >99.5 |
| 4.0 | <1 | >99.5 |
| 4.5 | <1 | >99.5 |
| 5.0 | 0.78 | 99.74 |
| 6.0 | 0.20 | 99.93 |

Advantage of the Invention:

The main advantages of the present invention over the previous inventions are:

(a) In the present process the same catalyst can be used for fixed bed sweetening of different petroleum fractions like FCC gasoline, kerosene, ATF, heavy naphtha, thermal gasoline, diesel and distillate fuel oil.

(b) The present process uses halogenated metal phthalocyanine as catalyst that unlike conventional sulphonated phtalocyanine catalyst is not leached out from the bed either by alkali or hydrocarbon.

(c) The present process can be used for fixed bed sweetening of a range petroleum distillate containing different type of thiols including long chain thiols, tertiary thiols and aromatic thiols.

(d) In the present process the impregnation of the catalyst on fixed bed is easier and take relatively less time than conventional processes.

(e) In the present process regeneration of catalyst on the bed is easily done.

We claim:

1. A process for fixed bed sweetening of petroleum distillates using a dichloro- or dibromo- cobalt or iron phthalocyanine as a catalyst which comprises impregnating the catalyst on an activated charcoal bed by circulating an alcoholic alkaline solution of the catalyst through said activated charcoal bed until a colourless solution is obtained in the effluent, thereby obtaining a catalyst impregnated charcoal bed, passing tire petroleum distillate through said catalyst impregnated charcoal bed along with air or oxygen at a temperature in the range 20° C. to 100° C. at a pressure in the range 1 kg/cm$^2$ to 15 kg/cm$^2$ with a liquid hourly space velocity in the range 1 hr$^{-1}$ to 15 hr$^{-1}$ with continuous or intermittent injection of alkali solution of concentration in the range 0.5–20%, to obtain the desired low mercaptan level petroleum distillates.

2. A process as claimed in claim 1, wherein the alcoholic alkaline solution used is selected from methanolic and ethanolic solution of sodium hydroxide.

3. A process as claimed in claim 1 wherein said catalyst used is selected from dichloro cobalt phthalocyanine and dibromo cobalt phthalocyanine.

4. A process as claimed in claim 1 wherein the concentration of catalyst used in the fixed bed is in the range 0.1 wt % to 1 wt % of activated charcoal.

5. A process as claimed in claim 1, wherein said dichloro- or dibromo- cobalt or phthalocyanine is prepared by treating cobalt or iron phthalocyanine with a halogenating agent selected from the group comprising chlorine, bromine, iodine, thionyl chloride, sulphuryl chloride, phosphorus pentachloride, phosphorus oxychloride, phosphorus pentabromide and phosphorus trichloride.

6. A process as claimed in claim 1, wherein the petroleum distillate used is selected from diesel, kerosine and FCC gasoline.

7. A process as claimed in claim 1 wherein the temperature is about in the range 20° C. to 50° C.

8. A process as claimed in claim 1, wherein the pressure is about in the range 5 kg/cm$^2$–8 kg/cm$^2$.

9. A process as claimed in claim 1, wherein the liquid hourly space velocity (LHSV) is about in the range 1 hr$^{-1}$ to 6 hr$^{-1}$.

10. A process as claimed in claim 2, wherein said catalyst used is selected from dichloro cobalt phthalocyanine a dibromo cobalt phthalocyanine.

11. A process as claimed in claim 2, wherein the concentration of catalyst used in the fixed bed is in the range 0.1 wt % to 1 wt % of activated charcoal.

12. A process as claimed in claim 3, wherein the concentration of catalyst used in the fixed bed is in the range 0.1 wt % to 1 wt % of activated charcoal.

13. A process as claimed in claim 2, wherein said dichloro- or dibromo- cobalt or iron phthalocyanine is prepared by treating cobalt or iron phthalocyanine with a halogenating agent selected from the group comprising chlorine, bromine, iodine, thionyl chloride, sulphuryl chloride, phosphorus pentachloride, phosphorus oxychloride, phosphorus pentabromide and phosphorus trichloride.

14. A process as claimed in claim 3, wherein said dichloro- or dibromo- cobalt or iron phthalocyanine is prepared by treating cobalt or iron phthalocyanine with a halogenating agent selected from the group comprising chlorine, bromine, iodine, thionyl chloride, sulphuryl chloride, phosphorus pentachloride, phosphorus oxychloride, phosphorus pentabromide and phosphorus trichloride.

15. A process as claimed in claim 4, wherein said dichloro- or dibromo- cobalt or iron phthalocyanine is prepared by treating cobalt or iron phthalocyanine with a halogenating agent selected from the group comprising chlorine, bromine, iodine, thionyl chloride, sulphuryl chloride, phosphorus pentachloride, phosphorus oxychloride, phosphorus pentabromide and phosphorus trichloride.

16. A process as claimed in claim 2, wherein the petroleum distillate used is selected from diesel, kerosine and FCC gasoline.

17. A process as claimed in claim 2, wherein the petroleum distillate used is diesel.

18. A process as claimed in claim 2, wherein the petroleum distillate used is FCC gasoline.

19. A process according to claim 1, wherein said injected alkali solution comprises sodium hydroxide.

20. A process as claimed in claim 1 wherein said dichloro- or dibromo- cobalt or iron phthalocyanine is unsulfonated.

21. A process as claimed in claim 1 wherein said dichloro- or dibromo- cobalt or iron phthalocyanine is insoluble in alkali or hydrocarbon during the sweetening process.

* * * * *